US006966240B2

(12) United States Patent
Kipfelsberger

(10) Patent No.: US 6,966,240 B2
(45) Date of Patent: Nov. 22, 2005

(54) HYDRAULIC RATCHET WRENCH WITH DOUBLE-ACTION HYDRAULIC CYLINDER PISTON DRIVE

(76) Inventor: Alexander Kipfelsberger, Welfenstrasse 7, 85051 Ingolstadt (DE)

( * ) Notice: Subject to any disclaimer, the term of this patent is extended or adjusted under 35 U.S.C. 154(b) by 0 days.

(21) Appl. No.: 10/666,943

(22) Filed: Sep. 19, 2003

(65) Prior Publication Data

US 2004/0103762 A1 Jun. 3, 2004

(30) Foreign Application Priority Data

Sep. 19, 2002 (EP) ..... 02020916

(51) Int. Cl.[7] ..... B25B 13/50

(52) U.S. Cl. ..... 81/57.44; 173/206; 173/218

(58) Field of Search ..... 173/218, 206, 173/212, 213; 81/57.44

(56) References Cited

U.S. PATENT DOCUMENTS

| | | | | |
|---|---|---|---|---|
| 4,805,496 | A * | 2/1989 | Wagner et al. | 81/57.39 |
| 5,782,158 | A * | 7/1998 | Rothering | 91/38 |
| 6,012,360 | A * | 1/2000 | Concha | 81/57.39 |
| 6,029,546 | A * | 2/2000 | Gibson et al. | 81/57.44 |
| 6,295,913 | B1 * | 10/2001 | Rothering | 91/38 |
| 6,553,873 | B2 * | 4/2003 | Collins et al. | 81/57.39 |

* cited by examiner

*Primary Examiner*—Joseph J. Hail, III
*Assistant Examiner*—Alvin J Grant
(74) *Attorney, Agent, or Firm*—McNair Law Firm, P.A.

(57) ABSTRACT

The invention relates to a hydraulic ratchet wrench with a double-action hydraulic cylinder piston drive with a gear pump (20) and a piston pump (21). According to the invention, a working stroke and a return stroke are controlled through a reversal of rotational direction of a pump motor (4), whereby the necessary flow volume is produced automatically via internal flow control valves, and without additional valve controls.

17 Claims, 7 Drawing Sheets

HYDRAULIC RATCHET WRENCH WITH DOUBLE-ACTION HYDRAULIC CYLINDER PISTON DRIVE

The invention relates to a hydraulic ratchet wrench with a double-action hydraulic cylinder having a piston drive with a gear pump and a piston pump. According to the invention, a working stroke and a return stroke are controlled through a reversal of rotational direction of a pump motor, whereby the necessary flow volume is produced automatically via valve arrangements, without additional valve control.

BACKGROUND OF THE INVENTION

In generally known hydraulic ratchet wrenches with double-action hydraulic cylinders, a piston is movable within the hydraulic cylinder as a disk piston with a piston rod tightly protruding from the hydraulic cylinder for ratchet actuation. Within the hydraulic cylinder, the displaceable piston constitutes a working stroke chamber as a high-pressure chamber on one side of the piston, and a return stroke chamber as a low-pressure chamber on the piston side with the piston rod.

The known hydraulic ratchet wrench furthermore comprises a two-phase hydraulic pump arrangement with a gear pump and a piston pump. The gear pump and the piston pump are driven by means of a pump motor controlled by pump motor controls via the pump motor's drive shaft. Thus, thanks to its construction, the gear pump is able to pump hydraulic oil with relatively high conveying capacity per motor revolution, up to a pressure of about 100 bar. The piston pump, on the other hand, is able to pump a relatively lower quantity of hydraulic oil per motor revolution, however at considerably higher pressures. The pump arrangement is connected via hydraulic controls to the working stroke chamber and the return stroke chamber.

This known pump arrangement is controlled by the hydraulic controls so that in the first phase of a wrenching process, when still no or only little torque is to be provided in the ratchet unit, the working stroke chamber is filled by the gear pump pumping rapidly and with high conveying capacity. In a second phase, towards the end of the wrenching process, when a high wrenching torque is to be produced, the hydraulic controls disengage the gear pump and engage the piston pump, so that the latter pumps with greater pressure into the working stroke chamber. The switchovers in the hydraulic lines required for this (in particular the switchover of advance and return at the hydraulic cylinder stroke chambers) is effected by expensive, break-down prone valves, in particular by solenoid valves requiring their own supply of energy. As a result, the energy requirements are relatively great for the installation, in particular for the drive motor. This in turn leads to unfavorably great heat production in the hydraulic oil. It is therefore necessary, in these known systems, to cool the hydraulic oil with expensive coolers and/or to use heavy and large oil tanks with a large volume of hydraulic oil, thus rendering operations more difficult.

It is the object of the present invention to further develop a hydraulic ratchet wrench of this type with a double-action hydraulic cylinder drive so that an economic, reliable and simple design, together with lower weight, smaller dimensions and low energy consumption is possible.

SUMMARY OF THE INVENTION

The above objectives are achieved according to the present invention by providing a first gear pump connection connected to a working stroke oil line and a second gear pump connection connected to a return stroke oil line. The working oil line is connected at a first connection point to an oil tank via a first suction port and a first suction check valve. The return stroke oil line is connected at a second connection point via a second suction port and a second suction check valve. A high-pressure check valve with blocking effect in the direction of the first connection point is provided in the working stroke oil line. It is located between the first suction connection point and the working stroke chamber.

A piston pump is designed as a radial piston pump, but piston pumps of a different design could also be used with the same effect. An embodiment of the radial piston with three small piston cylinders offset relative to each other, whereby the pistons can be driven, e.g., via an eccentric disk, is a preferred embodiment. The radial piston pump is connected at a piston pump input by a piston pump line to the hydraulic oil reservoir. A piston pump delivering output is connected to the working stroke oil line.

In addition, a flowback oil line going into the oil tank is provided. This flowback oil line is connected to the working stroke oil line between the first connection point and the high-pressure check valve. Thus a flowback of hydraulic oil is released from the working stroke oil line to the oil tank when a given low pressure has been reached.

Furthermore, the hydraulic flowback line is connected to the working stroke oil line via an unblocking check valve controlled as a function of the pressure prevailing in the return stroke oil line with blocking direction in return flow direction.

The pump motor is actuated by the pump motor controls for a working stroke with one direction of rotation, so that the conveying output is at the first gear pump connection and the input at the second gear pump connection. For a return stroke, on the other hand, the pump motor is actuated to rotate in an opposite direction, so that the input is then located at the first gear pump connection, and the conveying output is located at the second gear pump connection. Due to its design, the radial piston pump can convey in the same conveying direction as either one of the drive rotation directions. If necessary, rotational element pumps with other rotational elements than in a gear pump can also be used in the direction of rotation and in the direction of conveying, insofar as they have an adequate effect.

The advantageous result of the above arrangement is that the gear pump produces a rapid piston advance at high conveying capacity at the beginning of a working stroke, e.g., up to 6 liters per minute. Thus, the conveying capacity of the radial piston pump is also increased. For the required associated emptying of the return stroke chamber, the latter is connected for flow with the other gear pump connection acting as an suction connection. Since the volume of hydraulic oil flowing into the working stroke chamber is greater than the hydraulic oil volume displaced from the return stroke chamber due to the volume of the piston rod, the gear pump is able to suction the difference in volume through the second suction port and the second suction check valve.

When a given low pressure set on the low-pressure limit valve is reached, e.g., a pressure of 70 bar, the valve opens so that the gear pump then pumps through the return stroke oil line into the oil tank. In addition, the high-pressure return valve closes and the radial piston pumps with a lower conveying capacity of, e.g., 0.6 liter per minute into the working stroke chamber in a second wrenching phase, whereby high pressures, e.g., up to 7000 bar, can be reached for a high wrenching torque. Advantageously, the flow direction change takes place automatically, thus no solenoid valves with outside controls are needed.

For a return stroke, the pump motor is actuated for rotation in the opposite direction so that the gear pump also conveys in the opposite direction. As a result, hydraulic oil is pumped into the return stroke chamber whereby the working stroke chamber is open for a return of hydraulic oil to the oil tank via the open unblocking check valve. A relatively low quantity of conveyed matter from the radial piston pump is added in this case to the return flow volume. Great pressure build-up in the return stroke chamber by the radial piston pump is not possible with this arrangement. A rapid retraction of the piston or of the piston rod is thereby advantageously achieved. For the return stroke only a change of the motor's direction of rotation is required whereby the valves used adjust themselves automatically in the arrangement as needed and without outside control. Conventional sealing rings on the piston can be subjected to high pressure only from the side of the working stroke chamber. This is taken into account with the present arrangement since only the gear pump takes effect in the return stroke chamber with maximum pressure of approximately 100 bar, thus the rings are secured. Contrary to the state of the art where a switch-over from working stroke to return stroke is effected by several expensive and malfunction-prone valves that are also controlled from the outside, only control for the reversal of the direction of rotation of the pump motor is required here whereby the valves used adjust themselves correctly and without outside energy. The design of the arrangement according to the present invention is therefore much simpler, less expensive, more compact and less heavy. The volume of the oil tank, in particular, can be smaller and the hydraulic oil does not heat up as much in operation.

Advantageously, safety limits of pressure are possible in the high-pressure range as well as in the low-pressure range. Gear pumps with a maximum pumping pressure of approximately 100 bar and, e.g., a conveying capacity of 0–6 liters per minute are commonly available on the market. When such a gear pump is used an operation of the installation in a low-pressure range of up to 70 bar is advantageous and has been proven in practical use as being suitable. Radial piston pumps with a maximum conveying capacity of approximately 700 bar are obtainable commercially and are well suited for the proposed installation. Due to the volume of the piston rod the ratio between the working stroke chamber volume and the return stroke chamber volume can be advantageously selected to be approximately 3:1. With the proposed installation a compensation of the different volume flows that are necessary is possible automatically and without outside control measures.

Known measures are available to control the pump motor in combination with the control of the wrenching process. The pump motor controls, in particular the right-hand/left-hand control, can be actuated manually or automatically whereby the wrenching process can be effected as a function of time, or as a function of operating pressure, as well as a function of torque. A current wrenching torque used as a control parameter can then be determined directly by a torque pick-up or indirectly via the currently assigned operating pressure or the current input requirement of the pump motor. Depending on circumstances and as required, the pump motor can be an electric motor, a pneumatic motor, or a hydraulic motor. In a further development, it is proposed that a free wheel be provided in the drive before the radial piston pump. Thus, the radial piston pump is driven with the direction of rotation for a working stroke so that the radial piston pump is not driven with an opposite direction of rotation for a return stroke. Since the radial piston pump pumps in the direction of the working stroke chamber in both directions of rotation because of its design, this may lead to undesirable noise during a changeover of the direction of rotation from a working stroke to a return stroke in spite of the relatively low conveying capacity of the radial piston pump. By providing the above-mentioned free wheel the noise level is reduced.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
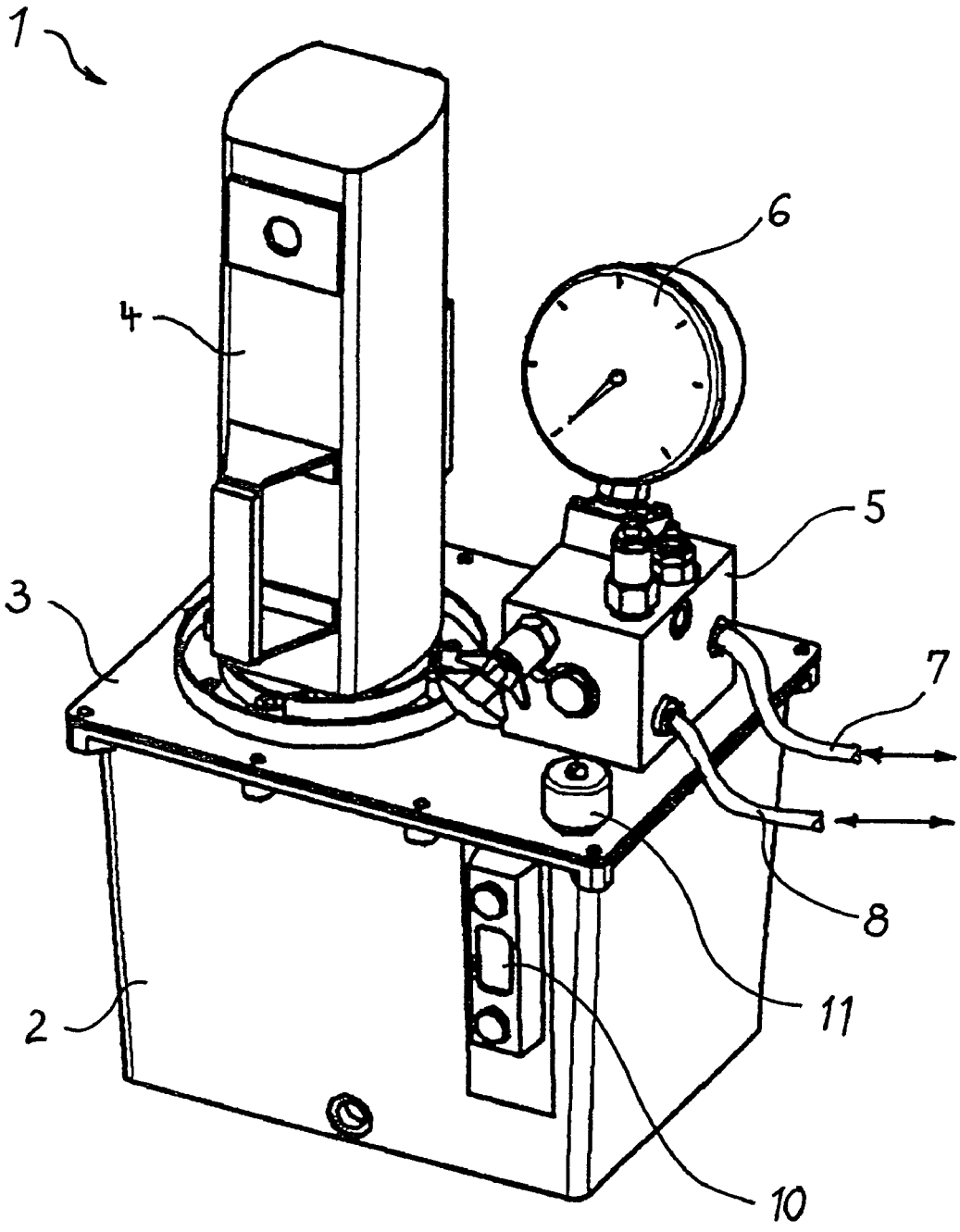
FIG. 1 shows a perspective view of the hydraulic pump installation with pump motor.

FIG. 1 shows the design of the hydraulic pump apparatus 1 of a hydraulic ratchet wrench. An oil tank 2 for hydraulic oil is covered by a covering plate 3 on which a pump motor 4 with vertical motor drive shaft is mounted. A gear pump (not shown here) and a radial piston pump driven by the motor drive shaft are installed in the oil tank 2. A hydraulics control unit 5 is mounted on the covering plate 3 and its circuit layout is described through FIG. 2. A high-pressure manometer 6 is connected to the hydraulics control unit 5. In addition, actuators for stop valves and control valves are shown. From the hydraulics control unit 5, a working stroke oil line 7 and a return stroke oil line 8 lead to a hydraulic cylinder 9 not shown here. Also shown are a tank level indication 10 and a tank ventilation system 11.

Figure 2:
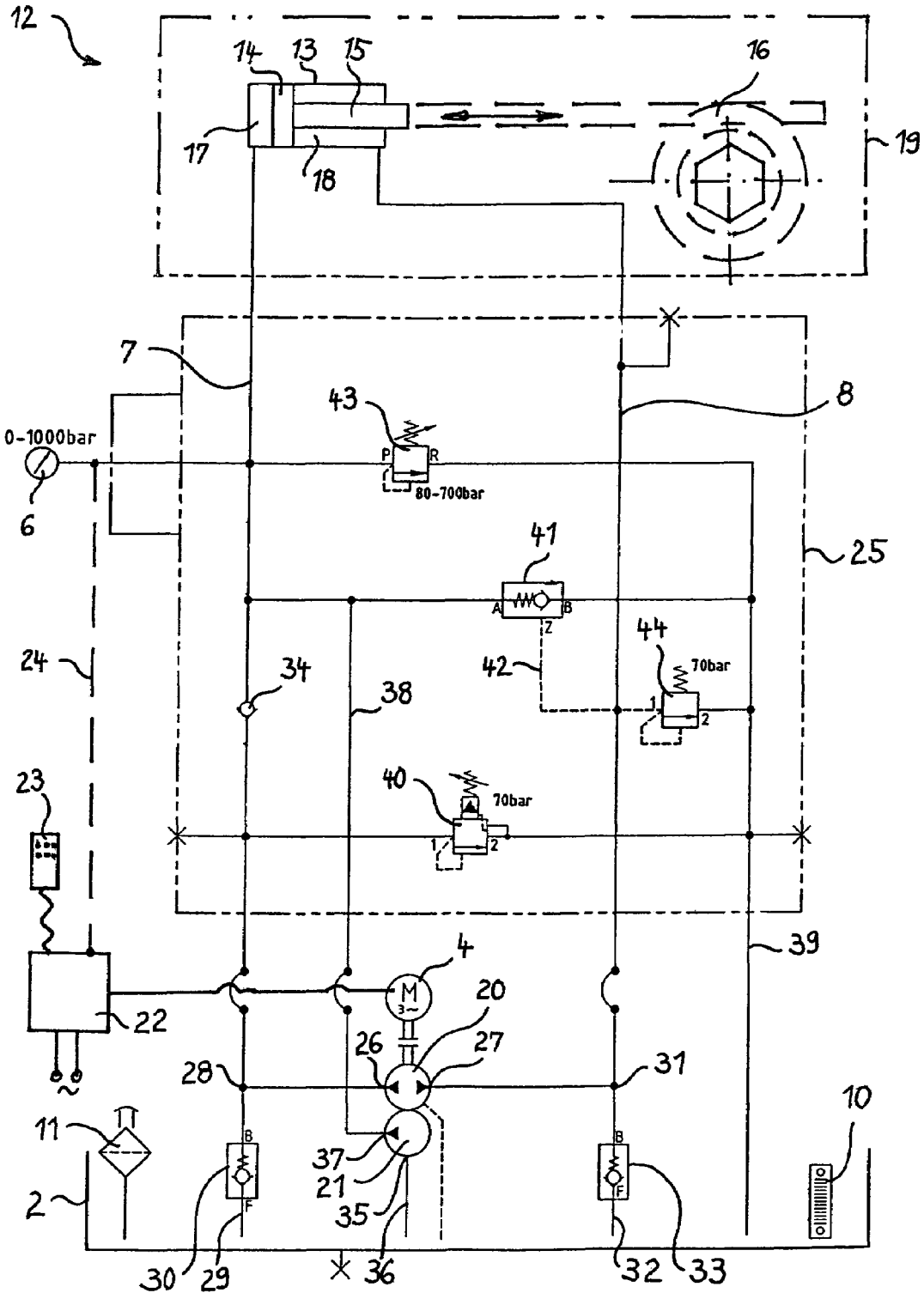
FIG. 2 shows a hydraulic diagram for a hydraulic pump installation with connected hydraulic cylinder and a schematically shown wrenching ratchet.

FIG. 2 schematically shows a hydraulic ratchet wrench 12 in combination with a hydraulic circuit diagram. A piston in the form of a disk piston 14 is located in hydraulic cylinder 13 and can be displaced therein whereby piston rod 15, or possibly an extension, engages a screw ratchet 16, indicated only schematically, in order to actuate it. On the left piston side in the hydraulic cylinder 13, there is a working stroke chamber 17, and on the right piston side a return stroke chamber 18 is formed within which the piston rod 15 is also capable of being displaced. The hydraulic cylinder 13 with its associated parts and the screw ratchet 16 constitute a unit 19 that is connected through flexible hydraulic lines to the hydraulic pump apparatus 1 according to FIG. 1.

The oil tank 2 contains the gear pump 20 and the radial piston pump 21 which are driven jointly by the drive shaft of the pump motor 4. The pump motor 4 is operated via pump motor controls 22 to which a manual actuating unit 23 and a working pressure conduit 24 are connected. These controls can be used, for example, for the entering of control parameters. The hydraulic circuit of the hydraulics control unit 5 is framed by frame 25 from which the high-pressure manometer 6 protrudes.

A first gear pump connection 26 is connected via the working stroke oil line 7 to the working stroke chamber 17 in the latter's end zone. A second gear pump connection 27, on the other hand, is connected by the return stroke oil line 8 to the return stroke chamber 18.

The working stroke oil line 7 is connected to the hydraulic oil tank 2 at a first connection point 28 via a first port 29 and a first suction check valve 30. The return stroke oil line 8 is connected to the hydraulic oil tank 2 at a second connection point 31 via a second suction port 32 and a second suction check valve 33.

A high pressure check valve 34 with a blocking action in the direction of the first connection point 28 is installed in the working stroke oil line 7, between the first connection point 28 and the working stroke chamber 17

The radial piston pump 21 has a piston pump input 35 that is connected to the hydraulic oil tank 2. A piston pump delivering line 38 goes from a piston pump conveying outlet 37 to a connection with the working stroke oil line 7 between the high pressure check valve 34 and the working stroke chamber 17. In addition, a hydraulic oil flowback line 39 goes into oil tank 2. This hydraulic oil flowback line is connected via a low pressure limit valve 40 to the working stroke oil line 7 between the high pressure check valve 34 and the first connection point 28.

In addition, the hydraulic oil flowback line 39 is connected via a preset pressure unblocking check valve 41 to the working stroke oil line 7 between the high-pressure check valve 34 and the working stroke chamber 17. The unblocking check valve 41 has a blocking effect in the direction of return or backflow and opens the return stroke oil line 8, and for that purpose a suitable pressure control conduit 42 goes from there to the unblocking check valve.

A high pressure limit valve 43 is connected between the working stroke oil line 7 and the hydraulic oil flowback line 39. Correspondingly, a low-pressure limit safety valve 44 is connected between the return stroke oil line 8 and the oil flowback conduit 39.

Figure 3:
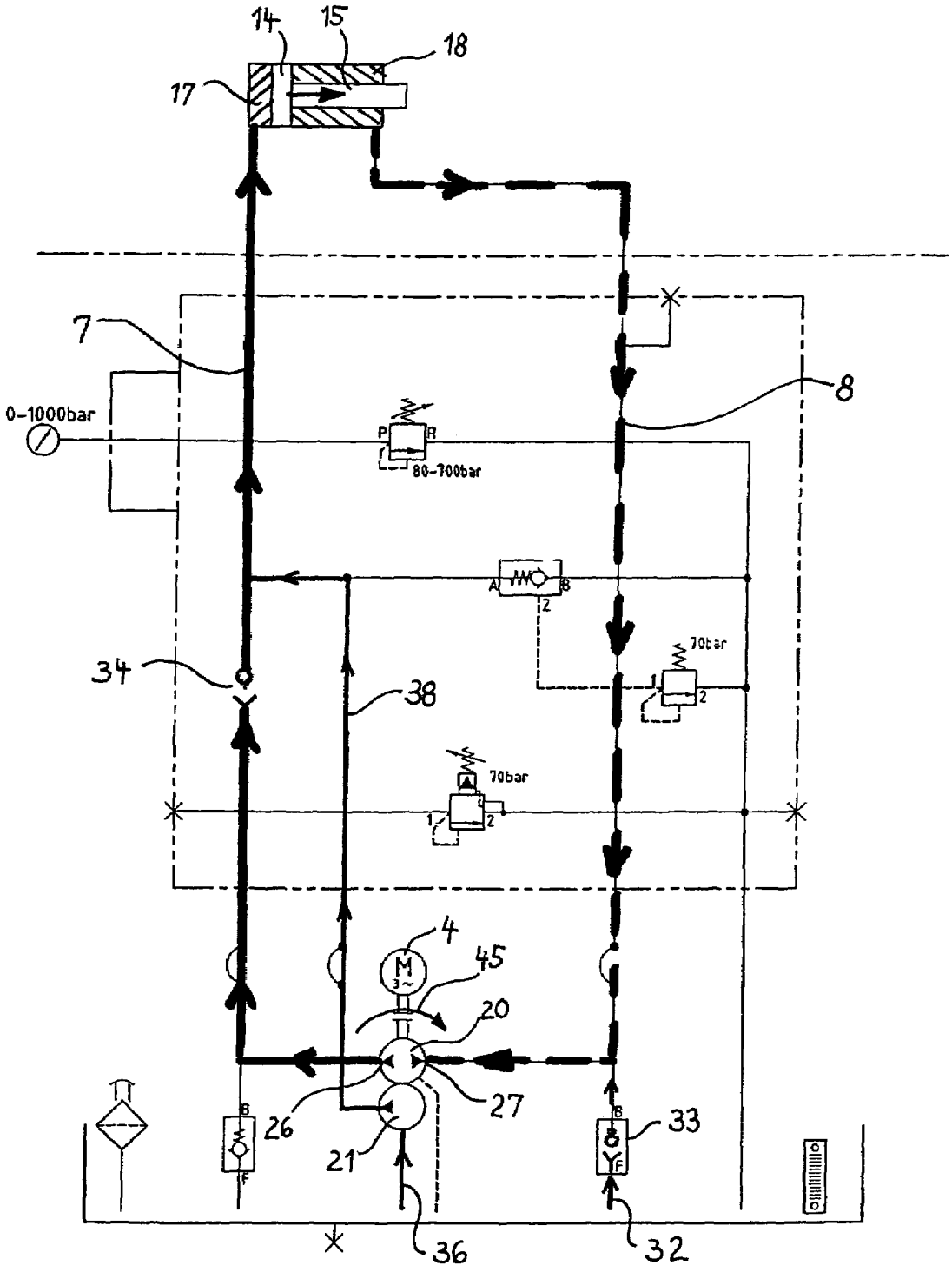
FIG. 3 shows the diagram of FIG. 2 with indication of the volume flows in a first phase of a working stroke.

FIG. 3 shows the hydraulic circuit of FIG. 2 (without screw ratchet 16 and pump motor controls 22), with volume flows shown in a first phase of a working stroke. For this the pump motor 4 is actuated with a right-handed rotation arrow 45 causing the delivering outlet on first gear pump connection 26 and the suction inlet of gear pump 20 on second gear pump connection 27 to be operable. As a result, gear pump 20 sucks hydraulic oil with great pump capacity from return stroke chamber 18 and, via return stroke oil line 8, pumps it into working stroke chamber 17. Due to piston rod 15, less hydraulic oil is displaced from the return stroke chamber 18 than is to be fed into the working stroke chamber 17. As the disk piston 14 is displaced, the gear pump 20 sucks the difference in volume, at least in part, through second suction port 32 and second suction check valve 33 which opens simultaneously. In addition, a relatively small amount of conveyed hydraulic oil is pumped by radial piston pump 21 via the piston pump suction conduit 36 and the piston pump delivering conduit 38 into the working stroke chamber 17. During this first phase the high pressure check valve 34 is open.

Figure 4:
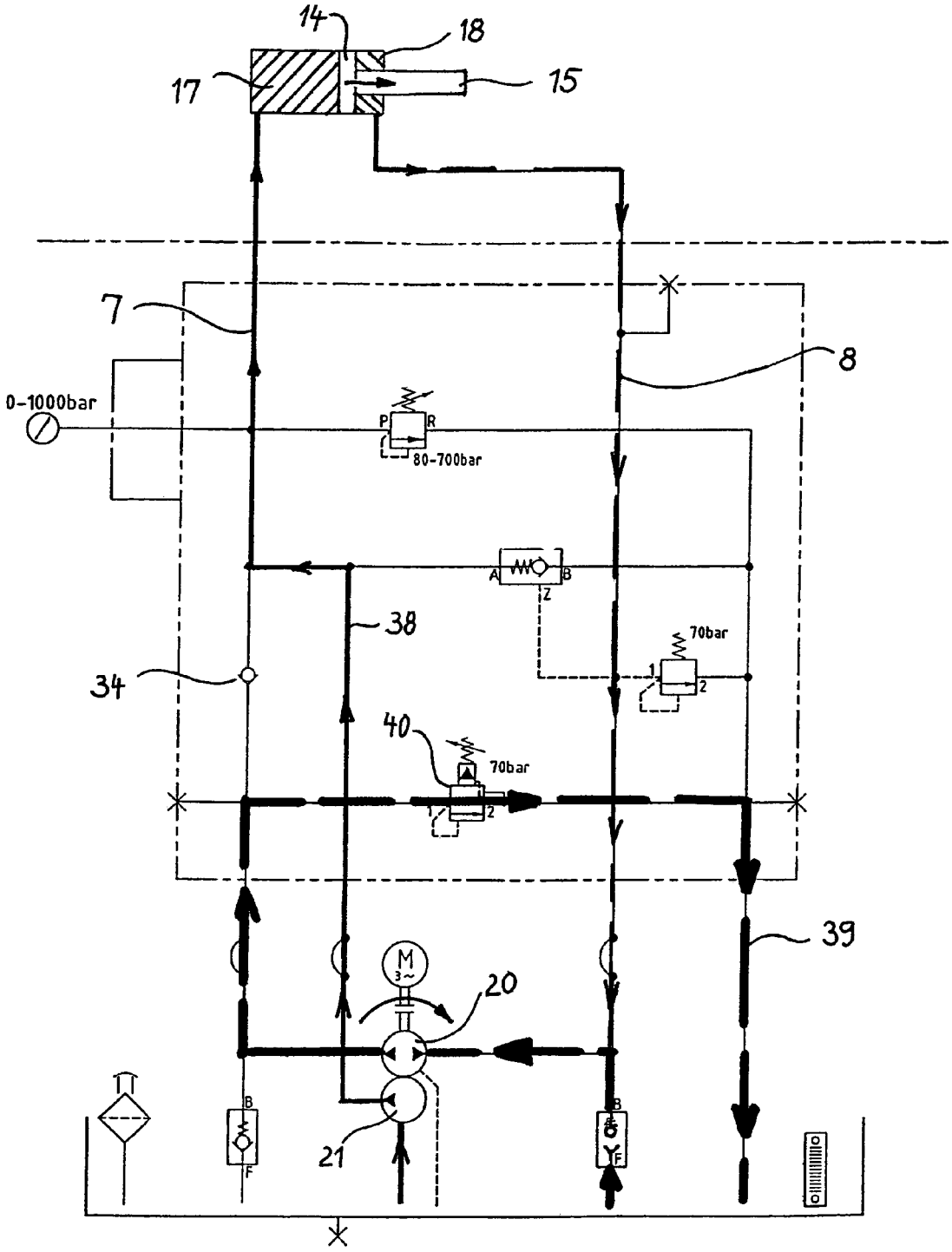
FIG. 4 shows the diagram of FIG. 2 with indication of the volume flows in a second phase of the working stroke.

FIG. 4 shows the second phase of a working stroke in which the working stroke chamber 17 is already extensively filled with hydraulic oil and piston rod 15 is extended accordingly. When a low pressure of 70 bar set at the low pressure limit valve 40 has been reached in the connected working stroke oil line 7 below the blocking direction of the high pressure check valve 34, the low pressure limit valve opens and the gear pump 20 runs without further connection to the working stroke chamber 17. Thus, the conduit with the low pressure limit valve 40 acts as a short circuit conduit to the hydraulic oil flowback line 39. The radial piston pump 21 connected with the piston pump delivering conduit 38 upstream of the high pressure check valve 34 continues to pump, although with lower conveying capacity, but with the possibility of a high pressure buildup into the working stroke chamber 17, whereby the high pressure check valve 34 is closed. Thanks to this additional pumping of radial piston pump 21, a high wrenching torque can be achieved by piston rod 15 in the second phase of the wrenching process.

Thus, it can be seen that high pressure check valve 34, low pressure limit valve 40, and second suction check valve 33 provide a work stroke valve arrangement which allow working oil to be delivered to the working chamber to accomplish the work stroke when the gear pump is rotated clockwise.

Figure 5:
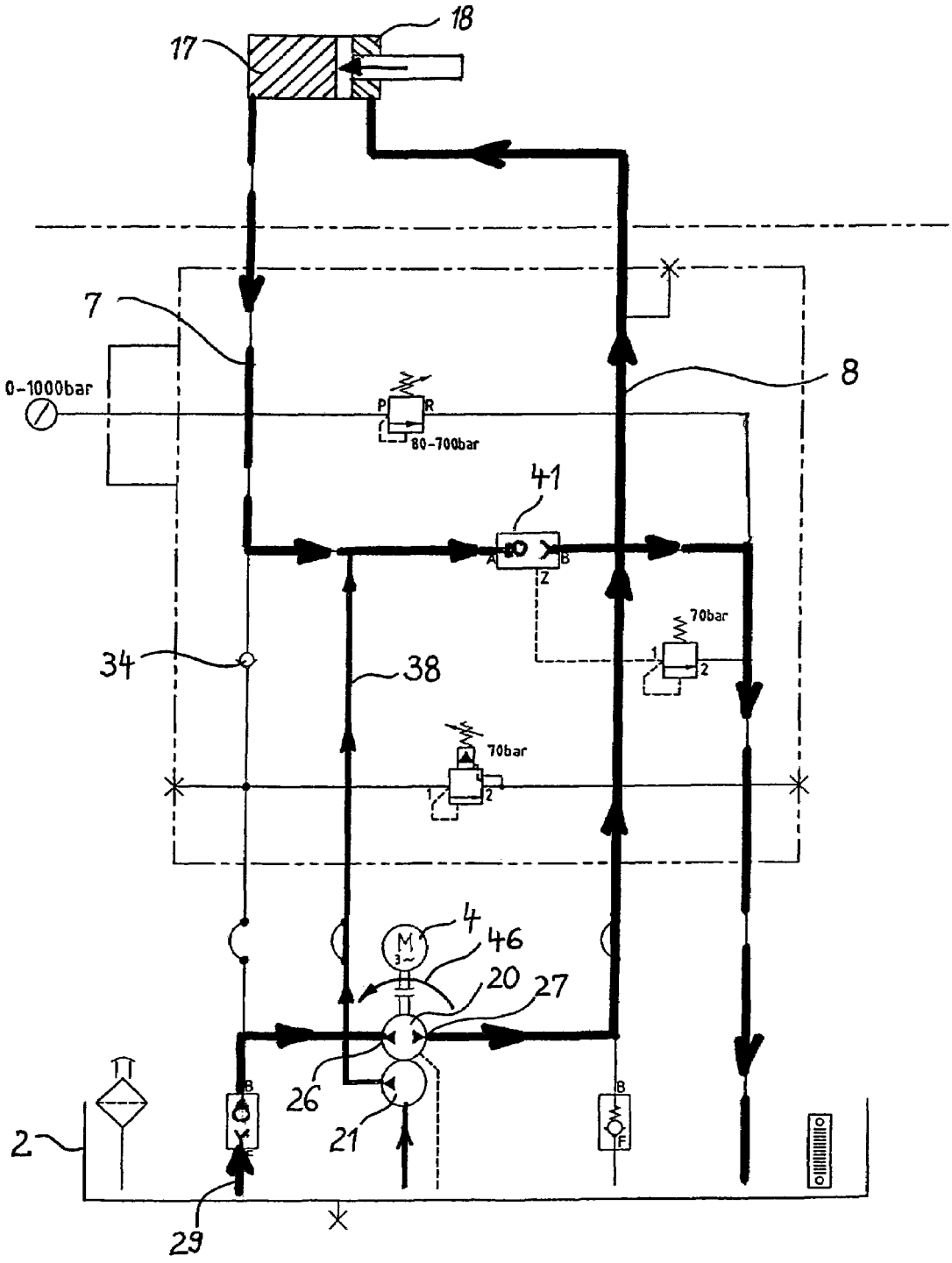
FIG. 5 shows the diagram of FIG. 2 with indication of the volume flows during a return stroke.

Upon completion of the wrenching process, or alternatively when several piston rod strokes following each other in the first phase of the wrenching process are needed, the disk piston 14 or the piston rod 15 must be brought back. The corresponding volume flows are shown in FIG. 5. For this, the pump motor 4 must be switched over to left-hand rotation (arrow 46). As a result input 26 at the first gear pump connection is formed for suction via the first port 29 and the conveying outlet is located at the second gear pump connection 27. The pumping direction of the gear pump 20 is also reversed through the reversal of the direction of rotation of the pump motor 4.

As a result, hydraulic oil is pumped into the return stroke chamber 18 by the gear pump 20 with great conveying capacity via return stroke oil line 8. In addition, hydraulic oil flows correspondingly from working stroke chamber 17 via working stroke oil line 7 upstream of the closed high pressure check valve 34 via the bypass conduit with the unblocking check valve 41 with preset pressure control, and via hydraulic oil flowback line 39 into the oil tank 2. The unblocking check valve 41 is opened due to the rise in pressure in the return stroke oil line 8 conveyed via the pressure control conduit to the unblocking check valve. In the return stroke chamber 18 the pumping pressure of the gear pump is therefore limited to 70 bar by the low is pressure limitation safety valve 44.

A return stroke valve arrangement for directing the return of oil to the reservoir is provided by high pressure check valve 34, first suction valve 30, and unblocking check valve 41.

Due to its design, the radial piston pump 21 also pumps in the same conveying direction with a left-hand rotation of the pump motor 4 so that the conveyed quantity of the piston pump is conveyed through the piston pump conveying conduit 38. However, since the latter is lower than the conveyed quantity of the gear pump 20, it is simply admixed with the hydraulic oil flowing out of the working stroke chamber 17 without interfering with the return stroke, and is also conveyed through hydraulic oil flowback line 39 to the oil tank 2.

Figure 6:
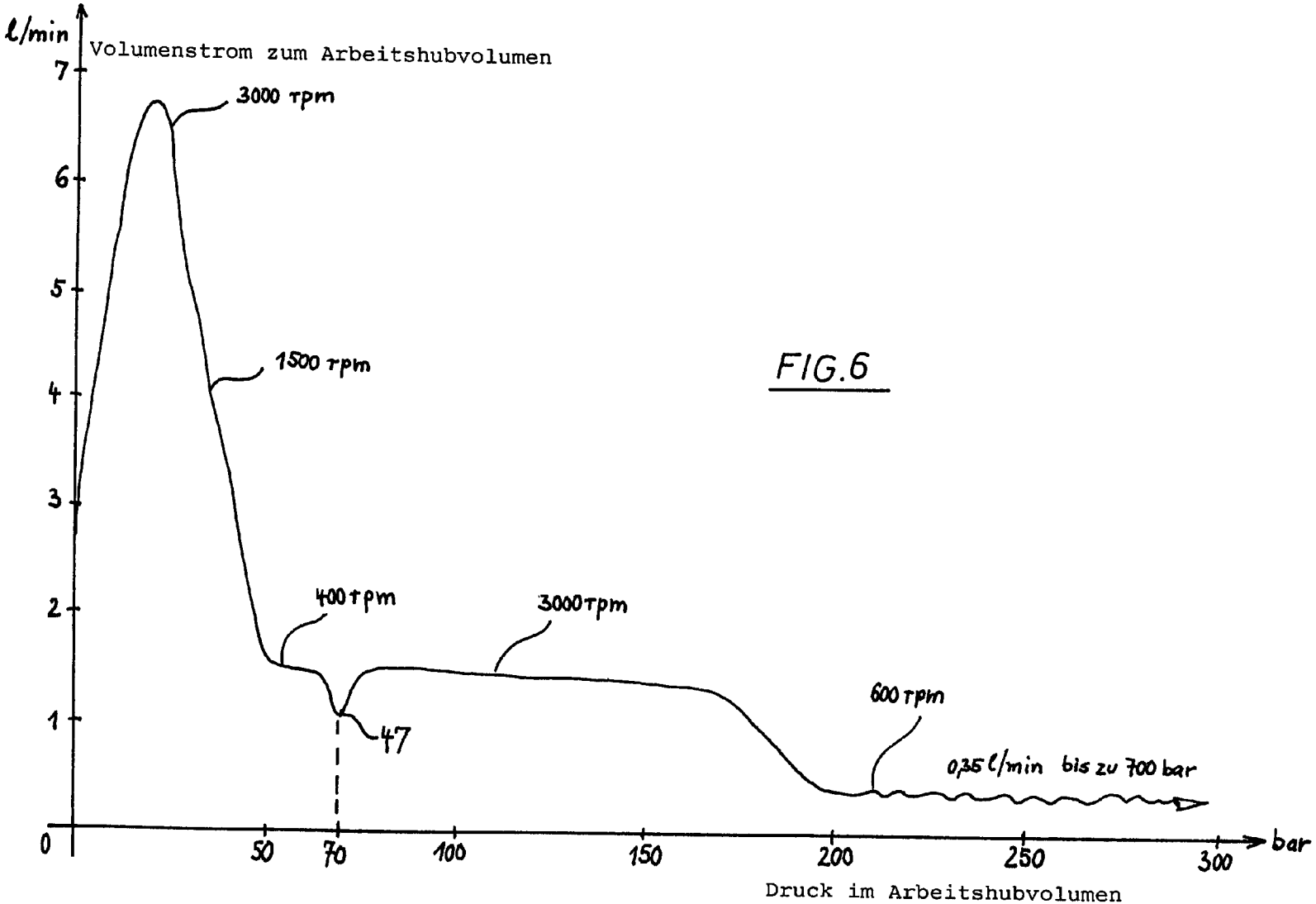
FIG. 6 shows a diagram from which the magnitude of the working stroke volume flow as the working pressure rises can be seen.

The diagram in FIG. 6 shows that up to a working pressure of approximately 70 bar, the gear pump 20 essentially ensures a rapid working stroke of the piston 14, whereby it can be recognized from the indicated motor speed, that the motor speed and the conveying capacity of the gear pump 20 drops from, for example, 3000 rpm's to approximately 400 rpm's as the counter-pressure rises. At approximately 70 bar the gear pump 20 is then disconnected from the working stroke chamber and the radial piston pump 21 takes over the pumping process into the working stroke chamber 17. Since relatively little volume per motor revolution is conveyed by the radial piston pump 21, the load of the pump motor 4 drops, so that its rotational speed increases again to e.g. 300 rpm's, causing also the radial piston pump 21 to run in the beginning with the indicated, still relatively high conveying capacity. At approximately 200 bar the conveying capacity drops, as well as the rotational speed of the pump motor 4, whereby it is then possible to continue pumping with e.g. a conveying capacity of 0.35 liter per minute until the maximum achievable pressure of approximately 700 bar is reached.

Figure 7:
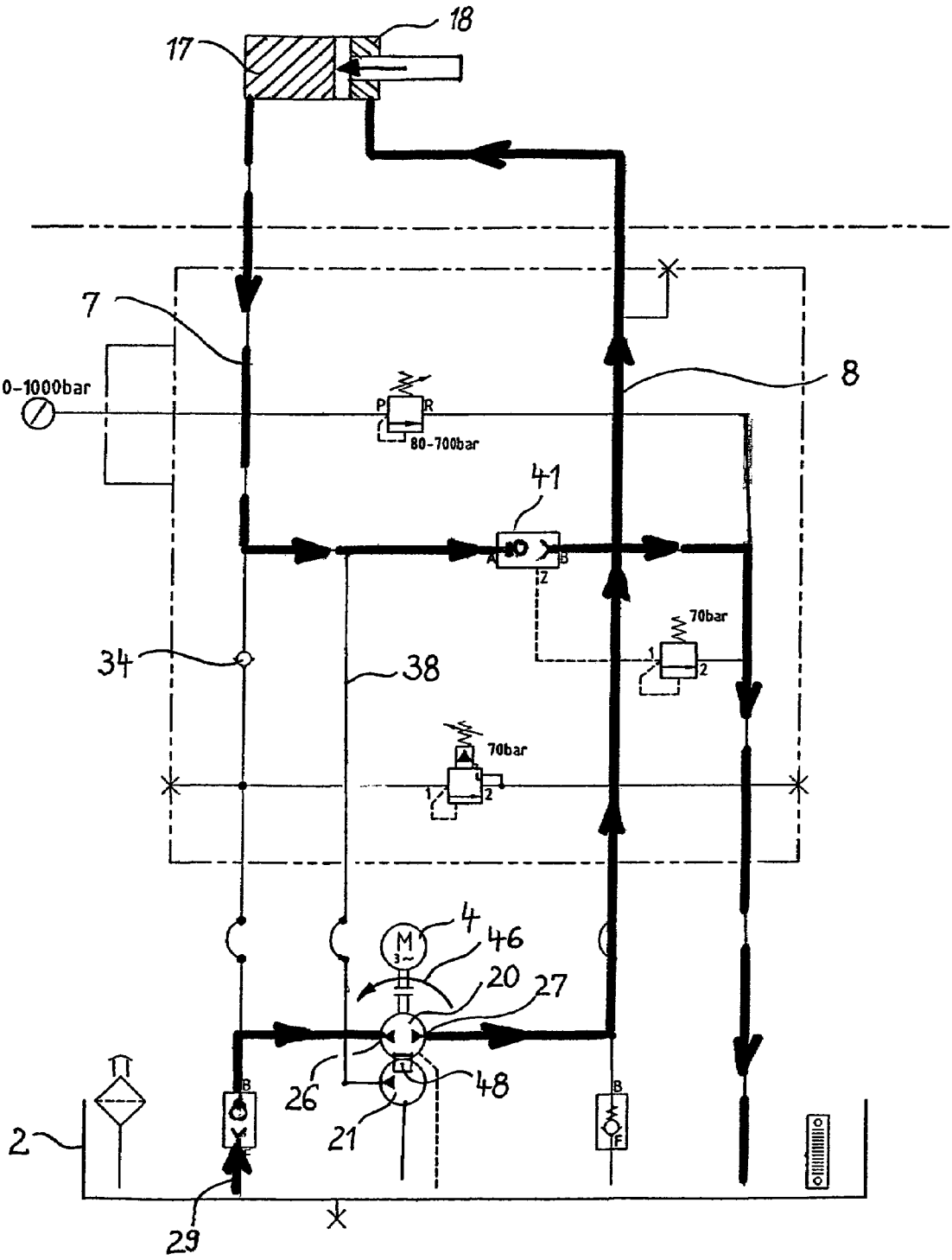
FIG. 7 shows a hydraulic pump system with a free wheel for the radial piston pump during a return stroke.

FIG. 7 is essentially identical with FIG. 5, however a free wheel 48 is installed in the drive, upstream of the radial piston pump 21. The free wheel 48 is connected so that the radial piston pump 21 is driven with a rotational direction for a working stroke, but is not driven with an opposite rotational direction. Contrary to FIG. 5, the radial piston pump 21 does not pump any volume flow during the return stroke, as it is not needed during the return stroke.

While a preferred embodiment of the invention has been described using specific terms, such description is for illustrative purposes only. It is to be understood that changes and variations may be made without departing from the spirit or scope of the following claims.

What is claimed is:

1. A hydraulic circuit including:

a hydraulic ratchet wrench having a double-action hydraulic cylinder with a piston that is displaceable in the hydraulic cylinder, a piston rod actuating said ratchet, a working stroke chamber in the hydraulic cylinder having a high-pressure chamber on one piston side and a low-pressure return stroke chamber on the other piston side with the piston rod, a hydraulic pump arrangement with a gear pump and a piston pump connected via hydraulic controls to the working stroke chamber and the return stroke chamber to drive said wrench in alternating work strokes and return strokes, wherein said circuit comprises:

a gear pump connected to said working stroke chamber by a working stroke oil line and connected by a return stroke oil line to said return stroke chamber;

said working stroke oil line connected to an oil reservoir by a first suction port;

said return stroke oil line connected to said oil reservoir by a second suction port;

an oil backflow line connected to said working stroke oil line and said oil reservoir, and a blocking valve arranged in said backflow line to selectively deliver an oil flow from said working stroke oil line;

said piston pump connected to said oil reservoir by a piston pump suction line and to said working stroke chamber by said working stroke oil line;

a pump control actuating said gear pump in one direction of rotation for delivering oil through said working stroke oil line to said working stroke chamber, and actuating said gear pump in an opposite direction for delivering oil through said return stroke oil line to said return chamber;

a working stroke flow valve arrangement in communication with said working stroke oil line to direct a flow of working oil to said work stroke chamber during said work stroke;

a return stroke flow valve arrangement in communication with said return working stroke oil line and said oil backflow line to direct a flow of oil back to said oil reservoir during said return stroke; and said working stroke and return stroke valve arrangements operating automatically in response to flow conditions in one or more of said working stroke oil line, return stroke oil line, and backflow oil line caused by operating said gear pump in opposite directions.

2. The hydraulic circuit of claim 1 including a high pressure limit safety valve connected between said working stroke oil line and said oil backflow line.

3. The hydraulic circuit of claim 1 wherein said return stroke valve arrangement includes a low pressure limit safety valve connected between said return stroke oil line and said hydraulic oil backflow conduit.

4. The circuit of claim 1 wherein said piston pump is activated by said pump control in the same direction with both directions of pump rotation.

5. The circuit of claim 1 wherein said return stroke flow valve arrangement includes a first blocking check valve blocking flow in the direction of the first suction port installed between the first suction connection point and the working stroke chamber in the working stroke oil line.

6. The circuit of claim 5 wherein said return valve arrangement includes an unblocking check valve disposed between said work stroke oil line and said oil flowback line normally blocking oil flow from said work stroke oil line to said flowback line.

7. The circuit of claim 6 wherein said return stroke flow valve arrangement includes a suction check valve disposed in said work stroke oil line blocking oil flow to said oil reservoir.

8. The circuit of claim 7 wherein said work stroke valve arrangement includes a first blocking check valve blocking the flow of oil in the direction of the first suction port disposed in said work stroke oil line.

9. The circuit of claim 8 wherein said work stroke flow valve arrangement includes a low pressure limit valve between the first suction connection point and said working stroke oil line, whereby a flowback can be released by the low pressure limitation valve when a predetermined low pressure has been reached.

10. The circuit of claim 9 wherein said work stroke valve arrangement includes a suction check valve disposed in said return stroke oil line.

11. A hydraulic circuit including:

a hydraulic ratchet wrench having a double-action hydraulic cylinder, a displaceable piston located in said hydraulic cylinder, a piston rod actuating said ratchet, a working stroke chamber located in said hydraulic cylinder with a high-pressure chamber on one piston side and a low-pressure return stroke chamber on the other piston side with said piston rod, a hydraulic pump arrangement including a gear pump and a piston pump, connected via hydraulic controls to the working stroke chamber and the return stroke chamber, said gear pump and said piston pump being driven by means of a pump motor controlled by pump motor controls through its drive shaft, whereby the gear pump pumps a relatively large quantity of hydraulic oil per motor revolution and the piston pump pumps a relatively smaller amount per motor revolution, wherein said hydraulic circuit comprises:

a first gear pump connection connected to a working stroke oil line and a working stroke chamber;

a second gear pump connection connected to a return stroke oil line and to a return stroke chamber;

said working stroke oil line being connected to an oil tank by a first connection point via a first suction port and a first suction check valve;

said return stroke oil line being connected at a second connection point to said oil tank via a second suction port and a second suction check valve;

said working stroke oil line having a high pressure check valve with a blocking action in the direction of said first connection point between said first connection point and said working stroke chamber;

said piston pump being connected to said oil tank via a piston pump suction line having a piston pump delivering outlet connected to said working stroke oil line;

a hydraulic oil flowback line communicating with said oil tank;

said flowback oil line connected via a low pressure limit valve to said working stroke oil line whereby a flowback is delivered by the low pressure limit valve when a predetermined low pressure has been reached;

said flowback oil line being connected via an unblocking check valve controlled as a function of pressure in said return stroke oil line to said working stroke oil line, said unblocking check valve normally blocking flow to said flowback line; and a pump motor actuated for a working stroke in one direction of rotation to pump oil through said delivery outlet of said gear pump, said pump motor actuated for a return stroke to rotate in the opposite direction, to pump oil through said suction inlet of said gear pump, and said radial piston pump pumping oil in the same direction with both directions of rotation.

12. The hydraulic circuit of claim 11 including a high pressure limit safety valve connected between said working stroke oil line and said oil flowback line.

13. The hydraulic circuit of claim 12 including a low pressure limit safety valve connected between said return stroke oil line and said oil flowback line.

14. The hydraulic circuit of claim 13 where said gear pump is able to produce a maximum conveying pressure of approximately 100 bar and at least one of said low pressure limit valve and said low pressure limit safety valve is adjusted to approximately 70 bar.

15. The hydraulic circuit of claim 14 where said radial piston pump produces a maximum conveying pressure of approximately 700 bar and said high pressure limit safety valve is adjusted within a range between said low pressure limit valve and approximately 700 bar.

16. The hydraulic circuit of claim 15 where the maximum working stroke chamber volume is greater than the maximum return stroke chamber volume and wherein the ratio is approximately 3:1.

17. The hydraulic circuit claim 16 where said pump motor controls are actuated manually or automatically and said wrenching process is controlled by one of manually, as a function of time as a function of working pressure and as a function of torque.

* * * * *